US011429037B2

(12) United States Patent
Haruyama

(10) Patent No.: US 11,429,037 B2
(45) Date of Patent: Aug. 30, 2022

(54) DEVELOPER CONTAINER AND IMAGE FORMING APPARATUS HAVING DEVELOPER OUTLET FOR DISCHARGING DEVELOPER

(71) Applicant: Oki Electric Industry Co., Ltd., Tokyo (JP)

(72) Inventor: Hiroki Haruyama, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/406,638

(22) Filed: Aug. 19, 2021

(65) Prior Publication Data

US 2022/0128927 A1 Apr. 28, 2022

(30) Foreign Application Priority Data

Oct. 23, 2020 (JP) ..... JP2020-178155

(51) Int. Cl.
*G03G 15/08* (2006.01)

(52) U.S. Cl.
CPC ..... *G03G 15/087* (2013.01); *G03G 15/0877* (2013.01); *G03G 15/0881* (2013.01); *G03G 15/0891* (2013.01); *G03G 2215/068* (2013.01); *G03G 2215/0668* (2013.01); *G03G 2215/085* (2013.01); *G03G 2215/0822* (2013.01)

(58) Field of Classification Search
CPC ..... G03G 15/087; G03G 15/0881; G03G 15/0891; G03G 15/0879; G03G 15/0877; G03G 2215/0668; G03G 2215/068; G03G 2215/0802; G03G 2215/0822; G03G 2215/085
See application file for complete search history.

(56) References Cited

U.S. PATENT DOCUMENTS 5,652,944 A * 7/1997 Masuda ..... G03G 15/32 399/24
2011/0052268 A1* 3/2011 Mano ..... G03G 15/0877 399/262
2015/0301481 A1 10/2015 Okuda

FOREIGN PATENT DOCUMENTS

EP 3255497 A1 12/2017
JP 2016194623 A 11/2016
JP 2020071405 A 5/2020

* cited by examiner

*Primary Examiner* — Walter L Lindsay, Jr.
*Assistant Examiner* — Laura Roth
(74) *Attorney, Agent, or Firm* — Rabin & Berdo, P.C.

(57) ABSTRACT

A developer container includes: a case that stores developer and in which a developer outlet for discharging the developer is formed; a conveying spiral that is rotatably disposed in the case and rotates to convey the developer toward the developer outlet in an axial direction of the conveying spiral; a guide wall that is disposed along the conveying spiral and guides the developer in the axial direction of the conveying spiral; and a push member that is attached to the conveying spiral and rotates with the conveying spiral to push the developer into the developer outlet. A cutout is formed at a portion of the guide wall corresponding to the push member to form a guide portion that guides the developer to the developer outlet.

8 Claims, 5 Drawing Sheets

DEVELOPER CONTAINER AND IMAGE FORMING APPARATUS HAVING DEVELOPER OUTLET FOR DISCHARGING DEVELOPER

BACKGROUND OF THE INVENTION

1. Field of the Invention

Embodiments of the present invention relate to a developer container and an image forming apparatus.

2. Description of the Related Art

Conventionally, there is an image forming apparatus, such as a printer, a copier, a facsimile machine, or a multifunction peripheral, in which an image forming unit is disposed, and that prints an image by uniformly charging a surface of a photosensitive drum with a charging roller, exposing the charged surface with an LED head to form an electrostatic latent image, developing the electrostatic latent image with toner as developer supplied from a toner container as a developer container to form a toner image, and transferring the toner image onto a paper sheet with a transfer roller, in the image forming unit, and fixing the toner image to the paper sheet with a fixing unit.

There has been provided a toner container in which a screw is rotated by driving force transmitted from a predetermined driving source in a printer to convey toner. In the toner container, as the screw is rotated, toner is conveyed toward a toner outlet formed in a bottom surface of the toner container (see, e.g., Japanese Patent Application Publication No. 2020-71405).

SUMMARY OF THE INVENTION

An object of an embodiment of the present invention is to provide a developer container and an image forming apparatus capable of smoothly discharging developer.

According to an embodiment of the present invention, there is provided a developer container including: a case that stores developer and in which a developer outlet for discharging the developer is formed; a conveying spiral that is rotatably disposed in the case and rotates to convey the developer toward the developer outlet in an axial direction of the conveying spiral; a guide wall that is disposed along the conveying spiral and guides the developer in the axial direction of the conveying spiral; and a push member that is attached to the conveying spiral and rotates with the conveying spiral to push the developer into the developer outlet, wherein a cutout is formed at a portion of the guide wall corresponding to the push member to form a guide portion that guides the developer to the developer outlet.

DETAILED DESCRIPTION OF THE INVENTION

Embodiments of the present invention will be described below with reference to the drawings. Here, a printer will be described as an example of an image forming apparatus.

Figure 2:
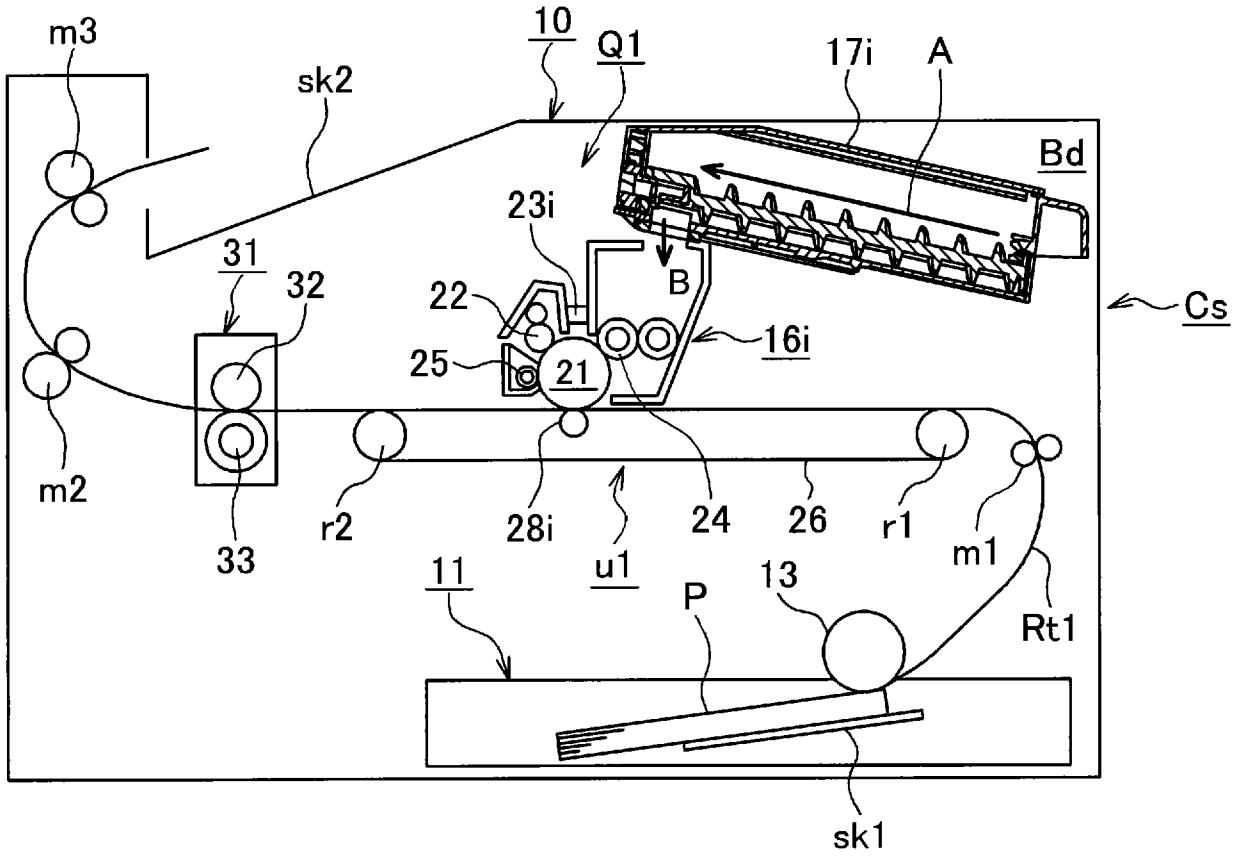
FIG. 2 is a conceptual diagram of a printer of the embodiment of the present invention.

FIG. 2 is a conceptual diagram of a printer 10 of an embodiment of the present invention.

In FIG. 2, the printer 10 includes a main body (or apparatus main body) Bd including a case Cs that is an exterior of the printer 10.

A sheet cassette 11 as a medium container is disposed in a lower portion of the apparatus main body Bd, and sheets (e.g., paper sheets) P as media are stored in the sheet cassette 11 in such a manner as to be stacked on a stacker sk1. Also, a hopping roller 13 as a feed member is disposed at a front end portion of the sheet cassette 11. The sheets P in the sheet cassette 11 are separated and fed one by one to a sheet conveying path Rt1 as a medium conveying path by rotating the hopping roller 13. The fed sheet P is conveyed on the sheet conveying path Rt1 by a pair of sheet feed rollers m1 as a first conveying member, and fed to an image forming portion Q1 disposed downstream of the pair of sheet feed rollers m1.

The image forming portion Q1 is constituted by image forming units 16*i* (i=1, 2, . . . , 4) for multiple colors, e.g., four colors of black, yellow, magenta, and cyan, toner containers 17*i* (i=1, 2, . . . , 4) as developer containers that store toners as developers of the respective colors and supply them to the respective image forming units 16*i*, LED heads 23*i* (i=1, 2, . . . , 4) as exposure devices, a transfer unit u1, and the like. Each toner container 17*i* conveys toner in the direction of arrow A and then discharges it in the direction of arrow B to supply it to the image forming unit 16*i*.

Each image forming unit 16*i* includes a photosensitive drum 21 as an image carrier, a charging roller 22 as a charging device, a developing roller 24 as a developer carrier, a cleaning roller 25 as a cleaning member, and the like. A surface of the photosensitive drum 21 is uniformly charged by the charging roller 22. The charged surface of the photosensitive drum 21 is exposed by the LED head 23, so that an electrostatic latent image as a latent image is formed. The electrostatic latent image is developed by the developing roller 24, so that toner supplied from the toner container 17*i* adheres to the surface of the photosensitive drum 21. Thereby, toner images as developer images of the respective colors are formed on the surfaces of the respective photosensitive drums 21.

The transfer unit u1 includes a drive roller r1 as a first roller, a driven roller r2 as a second roller, a transfer belt 26 as a belt movably supported and stretched by the drive roller r1 and driven roller r2, and transfer rollers 28*i* (i=1, 2, . . . , 4) as transfer members rotatably disposed to face the respective photosensitive drums 21 with the transfer belt 26 therebetween.

While a sheet P is fed to the image forming portion Q1 and conveyed through transfer portions between the photosensitive drums 21 of the respective image forming units 16*i* and the transfer rollers 28*i*, the toner images of the respective colors are sequentially transferred onto the sheet P in a superimposed manner by the transfer rollers 28*i*, so that a color toner image is formed. Toner remaining on the photosensitive drums 21 after the transfer of the toner images of the respective colors onto the sheet P is scraped off and removed from the photosensitive drums 21 by the cleaning rollers 25.

For convenience of illustration, in FIG. 2, for each of the image forming units 16*i*, toner containers 17*i*, LED heads 23*i*, and transfer rollers 28*i*, only one of them is illustrated.

A fixing unit 31 as a fixing device is disposed downstream of the image forming portion Q1 in the sheet conveying path Rt1. The fixing unit 31 includes a heating roller 32 as a first fixing member and a pressure roller 33 as a second fixing member, and a heater (not illustrated) as a heat source is disposed in the heating roller 32.

In the fixing unit 31, while the sheet P is conveyed through a fixing portion between the heating roller 32 and the pressure roller 33, the toner image on the sheet P is heated and fused by the heating roller 32, pressed by the pressure roller 33, and fixed to the sheet P.

The sheet P to which the toner image has been fixed is conveyed by a pair of conveying rollers m2 as a second conveying member, discharged by a pair of discharging rollers m3 as a third conveying member to the outside of the apparatus main body Bd, and placed on a stacker sk2.

Next, the toner containers 17*i* will be described.

Figure 1:
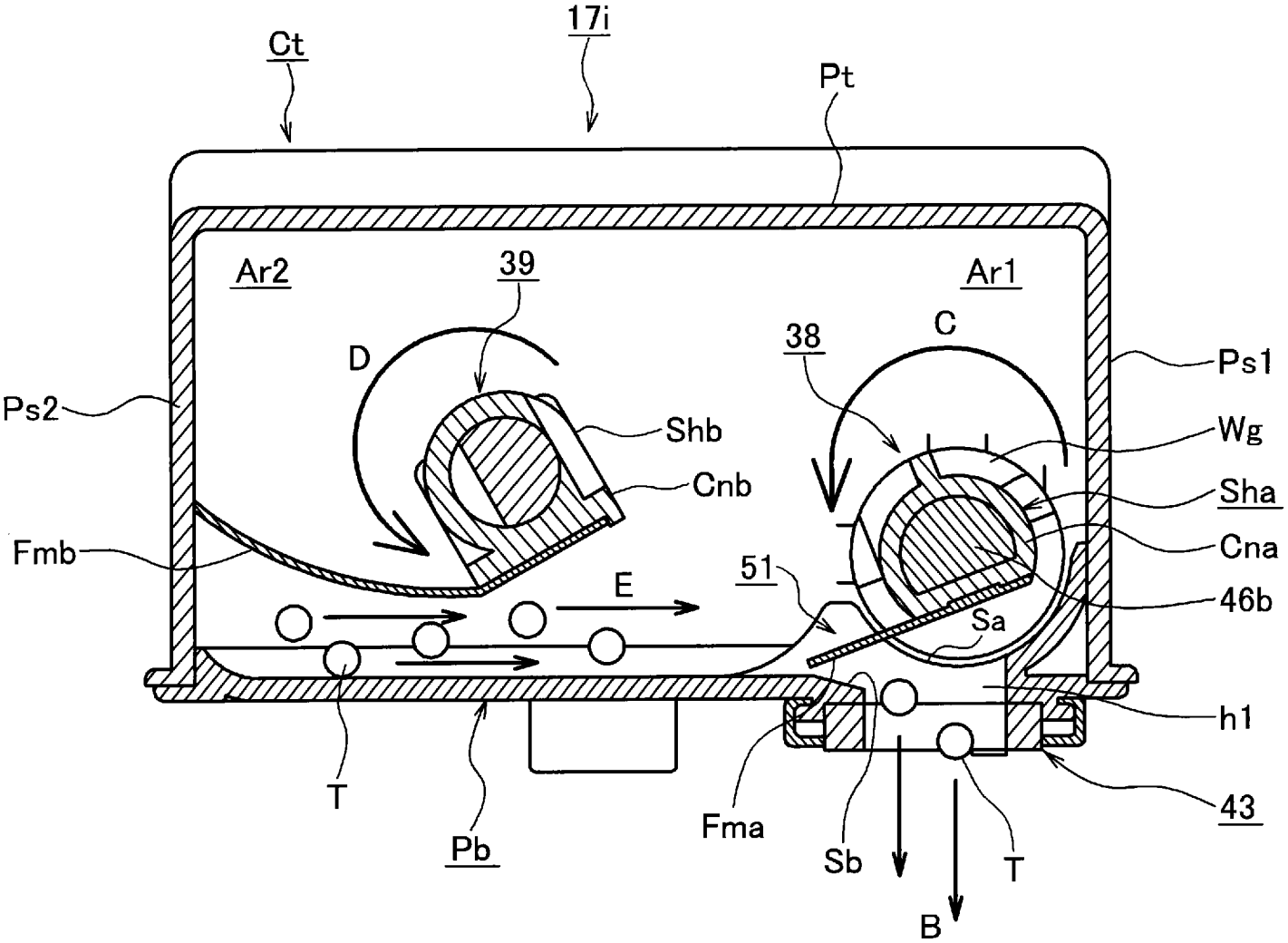
FIG. 1 is a transverse sectional view of a toner container of an embodiment of the present invention.
Figure 3:
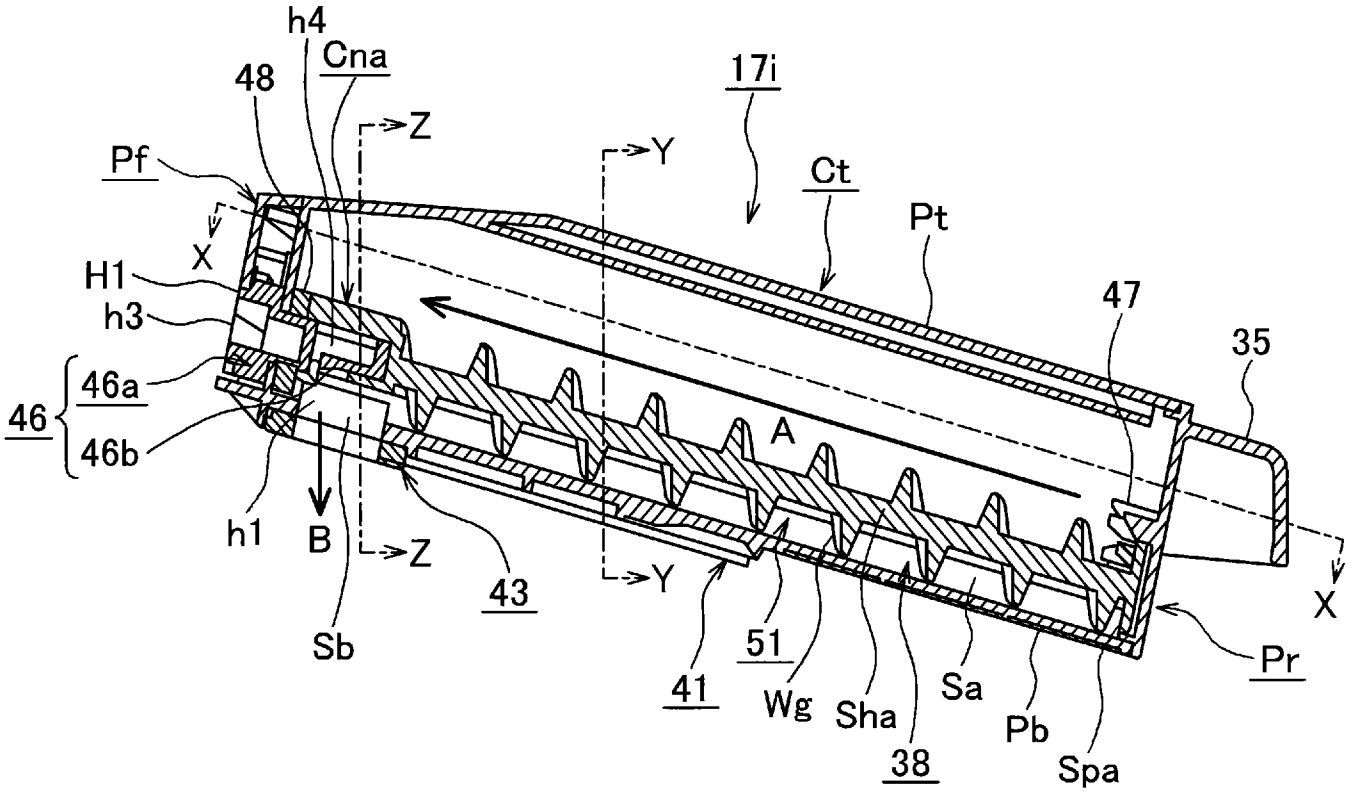
FIG. 3 is a longitudinal sectional view of the toner container of the embodiment of the present invention.
Figure 4:
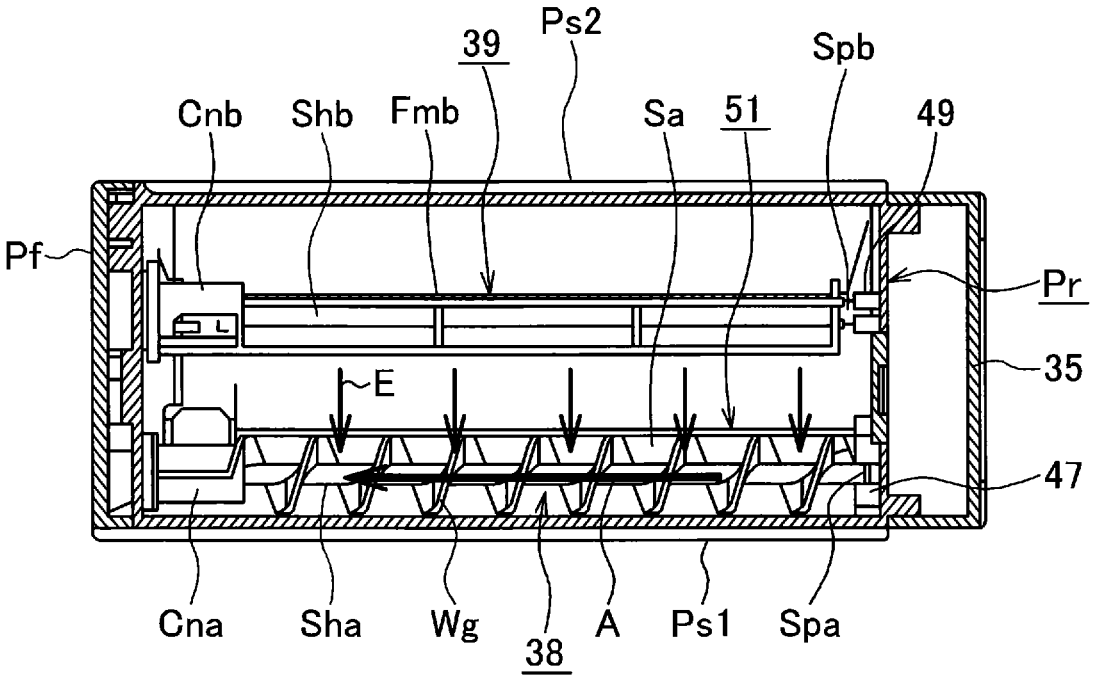
FIG. 4 is a sectional view taken along line X-X of FIG. 3.
Figure 5:
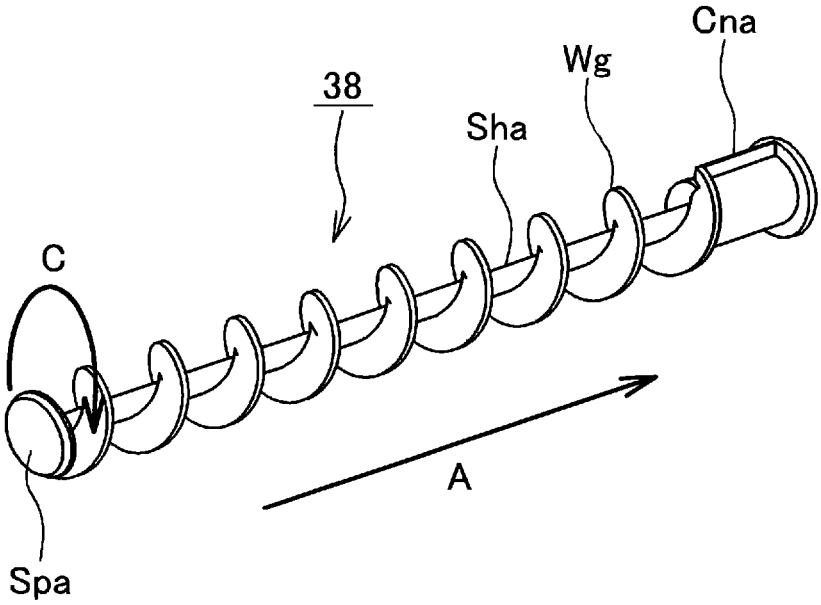
FIG. 5 is a perspective view of a screw of the embodiment of the present invention.
Figure 6:
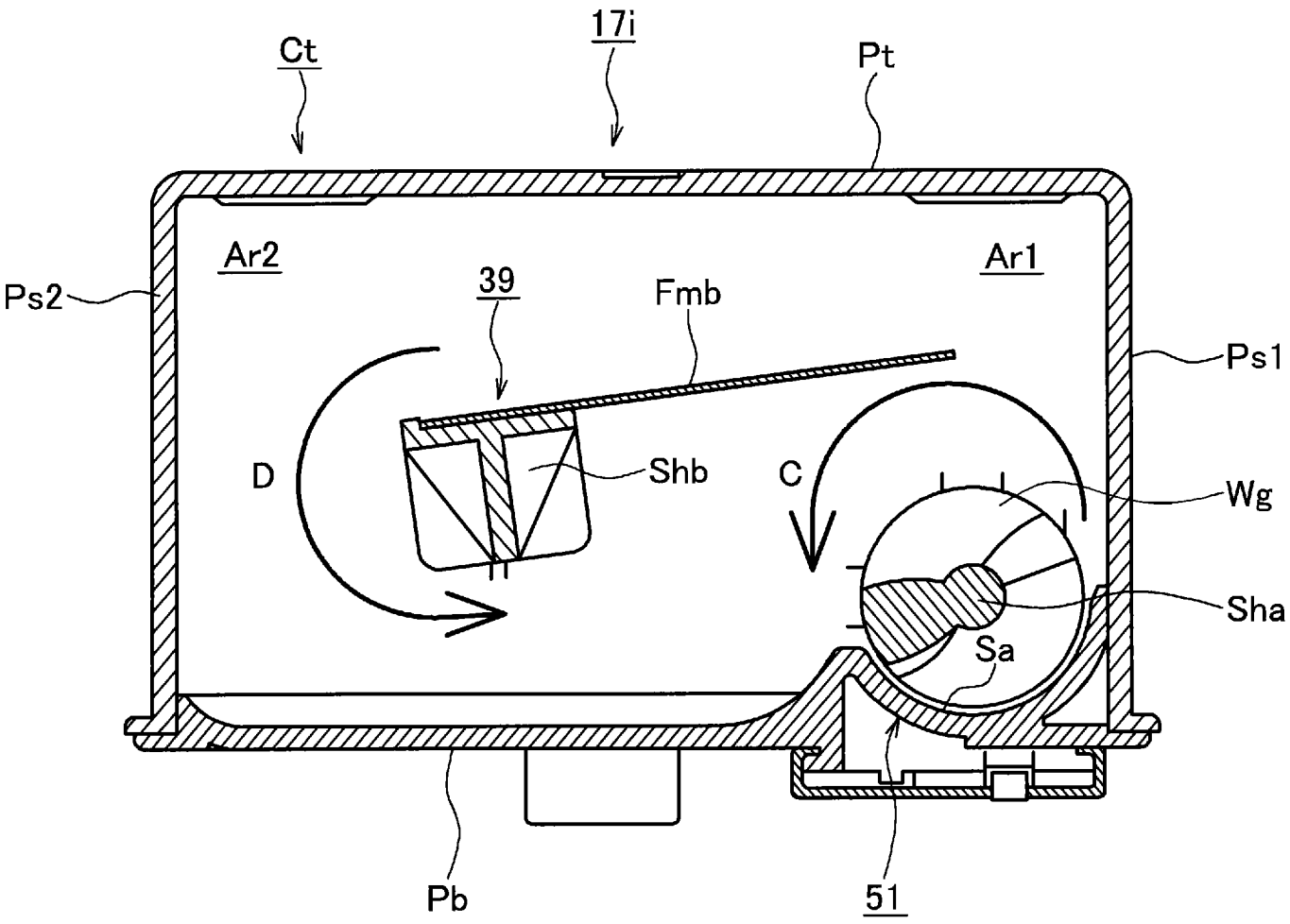
FIG. 6 is a sectional view taken along line Y-Y of FIG. 3.

FIG. 1 is a transverse sectional view of a toner container 17*i* of the embodiment of the present invention. FIG. 3 is a longitudinal sectional view of the toner container 17*i* of the embodiment of the present invention. FIG. 4 is a sectional view taken along line X-X of FIG. 3. FIG. 5 is a perspective view of a screw of the embodiment of the present invention. FIG. 6 is a sectional view taken along line Y-Y of FIG. 3. FIG. 1 is a sectional view taken along line Z-Z of FIG. 3.

In the drawings, the toner container 17*i* includes a case Ct that is an exterior of the toner container 17*i*. The case Ct includes a front panel Pf on the front side that is the downstream side in a conveying direction of the sheet P, a rear panel Pr on the rear side that is the upstream side in the conveying direction of the sheet P, a top panel Pt on the upper side, a bottom panel Pb on the lower side, a side panel Ps1 on the left side as viewed from the upstream side in the conveying direction of the sheet P, and a side panel Ps2 on the right side. Toner is stored in the case Ct.

The toner container 17*i* is installed on the upper side of the image forming unit 16*i* (see FIG. 2) in the printer 10 such that it is inclined by, for example, 10° relative to a horizontal direction with its front end higher than its rear end. This can reduce the projected area on a horizontal plane, thus allowing the printer 10 to be downsized.

A toner outlet h1 as a developer outlet for discharging toner T outside the toner container 17*i* is formed in a front end portion of the case Ct, or an upper end portion of the bottom panel Pb. Also, a shutter 41 as an opening and closing member for opening and closing the toner outlet h1 is disposed movably in the direction of arrow A relative to the case Ct. The shutter 41 moves between a closed position where it closes the toner outlet h1 and an open position where it opens the toner outlet h1. A sealing member 43 formed by an elastic body is disposed at the toner outlet h1 such that it surrounds an outer periphery of the toner outlet h1. When the shutter 41 is located at the closed position, the sealing member 43 seals a gap between the bottom panel Pb of the case Ct and the shutter 41.

Also, a handle 35 for an operator to grasp the toner container 17*i* when detaching it from the image forming unit 16*i* and drawing it from the printer 10 is formed on the upper side of an outer surface of the rear panel Pr of the case Ct to project therefrom.

In the case Ct, a toner conveying portion Ar1 as a developer conveying portion is formed on the side panel Ps1 side, and a toner storage portion Ar2 as a developer storage portion is formed on the side panel Ps2 side, in such a manner that they are each formed adjacent to a guide wall 51 to be described later. A screw 38 as a conveying spiral is rotatably disposed in the toner conveying portion Ar1, and an agitator 39 as a stored developer conveying member is rotatably disposed in the toner storage portion Ar2, in such a manner that they extend parallel to each other in a longitudinal direction of the case Ct. The screw 38 and agitator 39 are rotated by receiving rotation from a driving source (not illustrated) disposed in the printer 10.

The screw 38 includes a shaft Sha, a blade Wg formed by a spiral formed around the shaft Sha with a predetermined pitch, a connection Cna formed at an end of the shaft Sha on the front panel Pf side and having a D-shaped cross-section, and a supported portion Spa formed at an end of the shaft Sha on the rear panel Pr side and having a circular plate shape. As the screw 38 is rotated in the direction of arrow C, it conveys toner T from the rear panel Pr toward the front panel Pf, i.e., toward the toner outlet h1 in an axial direction (which is the direction of arrow A).

Also, a film Fma as a push member formed by an elastic body is attached to a front end portion of the screw 38, specifically a planar portion (or a D-cut portion) of the connection Cna. The film Fma is rotated with rotation of the screw 38 to convey and push toner T around the toner outlet h1 into the toner outlet h1.

A driving force transmitting member 46 is fitted in the connection Cna at the front end of the screw 38, and a support 47 formed in an inner wall of the rear panel Pr is engaged with the supported portion Spa at the rear end of the screw 38, so that the screw 38 is rotatably supported.

The driving force transmitting member 46 includes a driving force input portion 46*a* having a stepped cylindrical shape and rotatably supported by a bearing hole portion H1 including two through holes formed in the front panel Pf, and a driving force output portion 46*b* having a D-shaped cross-section. An engagement hole h3 formed in the driving force input portion 46*a* is engaged with a shaft (not illustrated) of a driving force transmitting system that transmits driving force from the driving source, and the driving force output portion 46*b* is engaged (or D-cut engaged) with an engagement hole h4 formed in the connection Cna.

Thereby, driving force transmitted from the driving source is transmitted to the screw 38 through the driving force transmitting member 46.

A ring-shaped sealing member 48 is disposed between the front end of the screw 38 and an inner surface of the front panel Pf to seal a gap between the screw 38 and the front panel Pf.

The agitator 39 includes a shaft Shb, a connection Cnb formed at an end of the shaft Shb on the front panel Pf side and having a D-shaped cross-section, and a supported portion Spb formed at an end of the shaft Shb on the rear panel Pr side and having a cylindrical shape. The shaft Shb is rotatably disposed to extend parallel to the screw 38.

Also, a film Fmb as a push member formed by an elastic body is attached to the shaft Shb. The film Fmb is rotated with rotation of the agitator 39 (or shaft Shb) in the direction of arrow D to agitate toner T in the toner storage portion Ar2 and push and convey toner T on the bottom panel Pb toward the guide wall 51 in the direction of arrow E.

A driving force transmitting member (not illustrated) for the agitator similar to the driving force transmitting member 46 is fitted in the connection Cnb at the front end of the agitator 39, and a support 49 formed in the inner wall of the rear panel Pr is engaged with the supported portion Spb at the rear end of the agitator 39, so that the agitator 39 is rotatably supported. Driving force from the driving source is transmitted to the agitator 39 through the driving force transmitting member for the agitator.

The screw 38 is rotated in the direction of arrow C, thereby conveying toner T in the direction of arrow A, which is the axial direction. At this time, if the entire outer periphery of the blade Wg of the screw 38 is open outward in radial directions, toner T between blades is released outward in radial directions by centrifugal force, and toner T cannot be stably conveyed.

Thus, in this embodiment, the guide wall 51, which covers a lower portion of the outer periphery of the blade Wg of the screw 38 is formed along the screw 38 in a portion of the toner conveying portion Ar1 facing the screw 38. The guide wall 51 includes an arc-shaped surface Sa, and is formed from the rear panel Pr to the front panel Pf to project such that the outer periphery of the blade Wg of the screw 38 is covered by the arc-shaped surface Sa. The guide wall 51 guides toner T in the axial direction of the screw 38.

If the guide wall 51 is formed entirely between the rear panel Pr and the front panel Pf, when the film Fma is rotated with rotation of the screw 38, the film Fma cannot reliably push toner T around the toner outlet h1 into the toner outlet h1. Specifically, in this case, since the film Fma discharges toner while rubbing toner against the guide wall 51, some toner cannot climb over the guide wall 51, and toner cannot be smoothly discharged.

Thus, in this embodiment, a cutout is formed at a portion of the guide wall 51 corresponding to the film Fma to form a guide portion that guides toner T to the toner outlet h1. For example, a guide portion for guiding toner T to the toner outlet h1 is formed by cutting out a portion of the guide wall 51 corresponding to the film Fma. In an aspect, the guide portion formed in the guide wall 51 is an inclined surface inclined downward toward the toner outlet h1. Specifically, an inclined surface Sb as a guide portion for guiding toner T to the toner outlet h1 is formed by cutting out a portion of the guide wall 51 adjacent to the toner outlet h1 and corresponding to the film Fma. The inclined surface Sb has a rectangular shape. The inclined surface Sb is formed by declining an edge portion of the bottom panel Pb on the side panel Ps2 side of the toner outlet h1 toward the side panel Ps1.

Next, an operation of the toner container 17*i* will be described.

When the amount of toner T in the image forming unit 16*i* is reduced due to image formation by the printer 10, driving force is transmitted from the driving source to the connections Cna and Cnb, the screw 38 and agitator 39 are rotated, and the films Fma and Fmb are rotated.

Thereby, toner T in the toner storage portion Ar2 is conveyed by the film Fmb toward the screw 38 in the direction of arrow E, conveyed along the screw 38 toward the toner outlet h1 in the direction of arrow A, and pushed into the toner outlet h1 by the film Fma.

Since the inclined surface Sb, which declines toward the toner outlet h1, is formed in the guide wall 51, the toner is reliably pushed into the toner outlet h1, smoothly discharged outside the case Ct, and supplies to the image forming unit 16*i*.

As described above, in this embodiment, since a portion of the guide wall 51, which is disposed along the screw 38, corresponding to the film Fma is cut out so that the inclined surface Sb is formed, it is possible to reliably push toner T into the toner outlet h1 by means of the film Fma without rubbing toner T against the guide wall 51. Thus, it is possible to smoothly discharge toner T.

In the above embodiment, the toner outlet h1 is formed in the front end portion of the case Ct. However, the toner outlet h1 may be formed in another portion of the case Ct. For example, the toner outlet h1 may be formed in a central portion of the case Ct in the axial direction. In this case, the screw 38 and guide wall 51 may be formed on both sides of the toner outlet h1.

The toner container 17*i* may be configured such that the case Ct has a first end portion and a second end portion opposite the first end portion in the axial direction, the toner outlet h1 is formed in the first end portion of the case Ct, and the case Ct is disposed to be inclined such that the first end portion is higher than the second end portion.

Although the above embodiment describes the printer 10, embodiments of the present invention can be applied to image forming apparatuses, such as copiers, facsimile machines, and multi-function peripherals.

Embodiments of the present invention are not limited to the above-described embodiments, and various modifications can be made thereto.

What is claimed is:

1. A developer container comprising:

a case that stores developer and in which a developer outlet for discharging the developer is formed;

a conveying spiral that is rotatably disposed in the case and rotates to convey the developer toward the developer outlet in an axial direction of the conveying spiral;

a guide wall that is disposed along the conveying spiral and guides the developer in the axial direction of the conveying spiral; and a push member that is attached to the conveying spiral and rotates with the conveying spiral to push the developer into the developer outlet, wherein a cutout is formed at a portion of the guide wall corresponding to the push member to form a guide portion that guides the developer to the developer outlet, the case has a first end portion and a second end portion opposite the first end portion in the axial direction, the developer outlet is formed in the first end portion of the case, and the case is disposed to be inclined such that the first end portion is higher than the second end portion.

2. The developer container of claim 1, wherein the guide portion formed in the guide wall is an inclined surface inclined downward toward the developer outlet.

3. The developer container of claim 1, wherein a developer storage portion that stores the developer is formed adjacent to the guide wall in the case, and a stored developer conveying member that conveys the developer toward the guide wall is disposed in the developer storage portion.

4. The developer container of claim 3, wherein the guide portion has an inclined surface inclined downward from a lower surface of the developer storage portion toward the developer outlet.

5. The developer container of claim 3, wherein the stored developer conveying member includes:

a shaft rotatably disposed to extend parallel to the conveying spiral; and a push member that is attached to the shaft and rotates with the shaft to push the developer toward the guide wall.

6. The developer container of claim 5, wherein in the axial direction, the push member of the stored developer conveying member extends so as to reach a position at which the guide portion is disposed.

7. An image forming apparatus comprising the developer container of claim 1.

8. The developer container of claim 1, wherein a center of a shaft of the conveying spiral is located above the guide wall.

* * * * *